US005242545A

United States Patent [19]

Bradway et al.

[11] Patent Number: 5,242,545

[45] Date of Patent: Sep. 7, 1993

[54] STARCH TREATED HIGH CRUSH LINERBOARD AND MEDIUM

[75] Inventors: Keith E. Bradway, Morgantown, Ind.; Richard F. Rudolph, Appleton, Wis.

[73] Assignee: Union Camp Corporation, Wayne, N.J.

[21] Appl. No.: 888,887

[22] Filed: May 26, 1992

Related U.S. Application Data

[63] Continuation-in-part of Ser. No. 317,152, Feb. 27, 1989, abandoned.

[51] Int. Cl.[5] ..... D21H 19/12

[52] U.S. Cl. ..... 162/135; 162/175; 162/184

[58] Field of Search ..... 162/175, 124, 135, 127, 162/184

[56] References Cited

U.S. PATENT DOCUMENTS

| | | | |
|---|---|---|---|
| 2,772,604 | 12/1956 | Muggleton | 92/40 |
| 4,093,016 | 6/1978 | Coleman | 162/124 |
| 4,191,610 | 3/1980 | Prior | 162/147 |

OTHER PUBLICATIONS

N. O. Bergh, D. Glittenberg, H. Weinbach, "Oberflachenbehandlung von Papier mit Leimpresse und Filmpresse," Jahrgang Heft 42:10A:V-40-V-47 (1988).

Casey, Pulp and Paper, 2nd Edition, p. 1114, Interscience Publishers, Inc., New York 1960.

Lee, Biological Methods in Paper Diagnosis, Paper Trade Journal, 107(6), pp. 53-59 (1938).

Paulapuro et al., "Effect of Pulp and Papermaking Variables on Linerboard Ring Crush," Pulp and Paper, pp. 142-145, 1983.

Simons, K. P., "Leimpresse Und Starke—Praktische Erfahrungen," 115(22) Wochenblatt Fur Papierfabrikation 1004 (1987).

*Primary Examiner*—Peter Chin

*Attorney, Agent, or Firm*—William K. Wissing

[57] ABSTRACT

Paper suitable for use in corrugated shipping containers is provided. Medium paper of this invention has a basis weight of at least about 15 pounds and a relatively high cross-direction crush resistance typically exceeding 2.4 pounds force per six inches width per unit base weight of the oven-dried product in lbs/1000 $ft^2$. Linerboard of this invention has a correspondingly greater cross-direction crush resistance. The paper is preferably produced by applying starch solutions at high percent solids at elevated temperatures using a size press technique to provide at least about 30% of the starch in a defined inner zone of the paper sheet. The strength of the paper is improved through a carefully controlled distribution of the starch throughout the thickness of the paper.

24 Claims, No Drawings

STARCH TREATED HIGH CRUSH LINERBOARD AND MEDIUM

This application is a continuation-in-part application of Ser. No. 317,152, entitled "Starch Treated High Crush Linerboard And Medium," filed Feb. 27, 1989 abandoned.

FIELD OF THE INVENTION

This invention relates to substrates that have been treated with starch-based saturants to improve their physical properties, and, more particularly, to improving the strength of corrugated paper and paperboard.

BACKGROUND OF THE INVENTION

Linerboard is a heavy weight paper, preferably kraft paper, that is used for the manufacture of corrugated cartons and the like. Medium is the configured material that is placed between the walls of the linerboard to make the corrugated structure. It has long been recognized that these materials need to be strong to maintain the integrity of corrugated blanks and to protect the contents of corrugated boxes properly during use.

One of the most important properties for linerboard and medium is the crush resistance. This is the ability of the material to resist forces applied in a columnar or compressive manner, such as when cartons are stacked in warehouses. Cartons must also resist end-to-end compressive forces during shipment. The compressive strength of corrugated materials can be measured in several ways. One way is to form the material into a ring with a diameter of approximately 2 inches, then crush the ring. The ring structure reinforces the board so that a true compressive failure occurs, rather than a mere bending. This is called the ring crush test.

The art has recognized that starch can often be applied to the surface of paper to "size" the surface to provide a smooth texture to the paper for writing. It is generally known that much of the starch applied to paper with a size press remains close to the surface. Those in the art have regarded this feature as advantageous, drawing a parallel to an "I-beam" that has good stiffness because it concentrates the mass near the extremities of its dimensions. See, e.g., Paulapuro et al., "Effect of Pulp and Papermaking Variables on Linerboard Ring Crush," Pulp and Paper, pp.142–145 (1983), which is hereby incorporated by reference. However, there are limitations as to how much starch can be applied to the surface of a linerboard. It is generally known that starch can close up the surface pores of a paper and retard the penetration of corrugation adhesives. This can either prevent bonding or result in weak bonding between the corrugated medium and the facing.

Others have recognized that it may be desirable to achieve penetration of starch into low basis weight or fine paper in order to build up the internal properties of the sheet for surface sizing applications. Casey, Pulp and Paper, 2nd Ed., p.1114, Interscience Publishers, Inc., New York (1960); Lee, "Biological Methods in Paper Diagnosis," 107(6) Paper Trade J. 53–59 (1938), which references are hereby incorporated by reference. Again, however, the process as described by Casey is more concerned with the overall smoothness of the paper surface for subsequent processing and not for improving crush strength.

Still others have done work on various methods of starch deposition. These include U.S. Pat. No. 2,772,604 (Muggleton), U.S. Pat. No. 4,093,016 (Coleman), and K. P. Simons, "Leimpresse Und Starke— Praktische Erfahrungen," 115(22) Wochenblatt Fur Papierfabrikation 1004 (1987).

The invention described in U.S. Pat. No. 4,191,610 (Prior) relates to use of sulfite waste liquor in a manufacturing process in order to improve the physical properties of the resulting paper. In using the sulfite waste liquor in a modified form, Prior allows for the utilization of mixed waste material as a starting material for producing containers such as corrugated boxes. The key goal of the Prior invention is the ability to make use of, and thereby dispose of, sulfite waste material (which has been considered a major pollution problem in the industry). Only as an addition to the sulfite waste liquor is the use of starch mentioned or discussed (see col. 7, lines 34–52.)

There is no implication in the Prior patent that improved starch application and the placement of significant amounts of the applied starch in the intermediate zone of the product can be accomplished in the absence of sulfite waste liquor. Prior teaches away from the accomplishment of such starch distribution, at least in the absence of sulfite waste liquor, by implying in its background discussion that starch would build up on the surface of the product and cause excessive brittleness (col. 3, lines 26–29).

Those of ordinary skill in this art field at the time of the present invention believed that using a heavier weight medium would, if anything, lead to a thicker medium that would be more resistent to effective starch penetration into the middle of the medium. At the same time, use of a higher starch solid composition would result in a thicker starch solution that would not penetrate as well as a lower starch solids solution. See N. O. Bergh, D. Glittenberg, H. Weinbach, "Oberflachenbehandlung von Papier mit Leimpresse und Filmpresse," JAHRGANG HEFT 42:10A:V-40–V-47 (1988). If the starch solid composition and/or the weight of the medium were increased, the state of the art would have predicted that there would be much less penetration of the starch. Thus, the ordinarily skilled artisan was led away from using higher starch solids compositions.

Accordingly, those skilled in the art have not demonstrated an appropriate teaching for significantly increasing the crush strength of corrugated materials by chemical means, such as starch.

SUMMARY OF THE INVENTION

High crush resistance paper, suitable for use in corrugated shipping containers, is provided by this invention. It has been found that if a starch, or starch-like, compound is applied to the paper in a manner such as to cause the starch to penetrate into the interior portions of the paper, the crush strength can be increased substantially. Accordingly, corrugated cartons made from the linerboard and medium of this invention can be manufactured from a lower basis weight material and still meet customer specifications for performance and strength.

In particular, this invention provides linerboard and medium having a relatively heavy basis weight, greater than about 20 lbs/1000 $ft^2$ (98 $g/m^2$), which is well above the basis weight of most fine paper grades. The cross-direction ring crush strength of the product of this invention exceeds 1.9 pounds force per 6 inches width per unit base weight of the oven-dried product in lbs/1000 $ft^2$ for medium, and 2.5 for liner. The machine-direction crush strength of the product exceeds 2.6 expressed in the same units for medium and 3.4 for liner. The paper of this invention further includes opposing surfaces having surface zones immediately adjacent to the opposing surfaces and an intermediate zone extending between the surface zones. While this may be conceived as a 3-layer composite, these zones are not necessarily distinct, but are merely used to represent differences in starch concentration within the thickness of the paper.

The paper of this invention further contains at least 3% starch by weight on a dry basis with at least about 10%, and preferably more than 30%, of the total added starch being distributed within the intermediate zone. In more preferred embodiments, a linerboard is provided that comprises a first thickness of at least about 0.008 inches and surface zones comprising a thickness of 2.5 mils.

Accordingly, improvements in the compression strength of paper products, such as linerboard and medium, have been observed by applying starch solutions at high percent solids (at least about 18% and preferably greater than 20%) at elevated temperatures using the size press techniques of this invention. These improvements also have resulted in an increase in the edgewise compression strength of the combined corrugated board and greatly improved compression strength of the resulting box. It has been discovered that about a 5% to 7% increase in both the cross-direction and machine-direction ring crush factors can be accomplished for every 1% of starch content for starch contents from about 4% to 10% by weight. The tensile strength per basis weight was shown to increase by about 2% to 3% for every 1% of starch content for starch contents from about 4% to 16%. This property has advantages for an alternate use for linerboard in the manufacture of slipsheets. Additionally, the bending stiffness, as measured using a Taber Stiffness Tester, was shown to increase from about 11% to about 13% for every 1% of starch content at starch contents from about 3% to about 6%.

The invention has also demonstrated significant and commercially applicable advantages. For instance, significant increases in machine speed on drier limited grades of linerboard and medium can be accomplished, since the basis weight of the products can be reduced without decreasing strength. Thus, overall manufacturing productivity of these materials on an area basis can be increased without increasing pulp mill capacity. The lower basis weight can significantly lower freight costs when shipping rolls of liners and medium or boxes and slipsheets. Since the novel method of this invention uses starch applied at higher solids, at least about 18%, manufacturers use less energy in the driers and can operate at high moisture contents into the size press. The frequency of the size press breaks will be lower since less re-wetting would be required and the operation would work principally with heavy weight grades. Other process benefits include the ability to use higher amounts of post-consumer waste in the furnish to yield the same strength properties, and the ability to refine less and still produce beneficial properties using starch at the dry end of the machine. The process, products, and the resultant advantages of the present invention are realized without the need to use any waste sulfite liquor of the kind disclosed in U.S. Pat. No. 4,191,610 (Prior).

The present invention accomplishes these advantageous results in a manner directly distinguishable from the prior art in three separate ways: (1) the claimed percentage of starch solid composition that is applied exceeds previously taught maximums; (2) th starch is required to be distributed within the interior of the paper product; and (3) the ring crush strength of the product will exceed that obtainable by prior art techniques.

It is, therefore, an object of this invention to provide a novel starch treated, high-crush strength linerboard and medium.

It is another object of this invention to provide a method of manufacturing high-crush linerboard and medium that can increase the structural properties of paper products without increasing basis weight.

With these and other objects, which will become apparent to one skilled in the art as the description proceeds, in view, this invention resides in the novel construction, combination, arrangement of parts, and methods substantially as hereinafter described and more particularly defined by the attached claims.

DESCRIPTION OF THE INVENTION

The preferred operable embodiments of this invention will now be described. In one preferred embodiment of this invention, a paper suitable for use in corrugated shipping containers is provided having a basis weight of at least about 20 lbs/1000 $ft^2$ (98 $g/m^2$) and a first thickness of at least about 0.008 inches. As used herein, the term "paper" refers to paper products suitable for use in making corrugated boxes and blanks, preferably paperboard, linerboard, and medium. The paper of this first embodiment further includes first and second opposing surfaces and first and second surface zones immediately adjacent to these first and second opposing surfaces. Each of the first and second zones has a defined second thickness of about 2.5 mils. These zones are defined with a predetermined thickness so as to define the intermediate zone therebetween, and to enable description of how much starch penetrates into the center of the paper. In a preferred embodiment of this invention, the paper contains at least about 3% by weight starch on a dry basis with at least about 30% of the total added starch being distributed within the intermediate zone of the paper between the two surface zones. With such starch penetration, the resulting cross-direction ring crush strength of medium is greater than 1.9 pounds force per 6 inches width per unit base weight of the oven-dried product in lbs/1000 $ft^2$.

In another embodiment of this invention, a linerboard is provided having a basis weight of at least about 30 lbs/1000 $ft^2$ (147 $g/m^2$) and a first thickness of at least about 0.008 inches. The linerboard further comprises first and second opposing surfaces, a first zone immediately adjacent to the first surface, and a second surface zone immediately adjacent to the second surface. As in the previous embodiment, an intermediate zone extends between the first and second surface zones. In this particular embodiment the first and second zones have a second thickness of 0.0025 inches or 2.5 mils. The linerboard further contains from about 3% to about 6% by weight starch on a dry basis with at least 30% of the total added starch being distributed within the intermediate zone. The linerboard further is characterized by having a cross-direction ring crush strength greater than about 2.5, and preferably greater than 2.7, pounds force per 6 inches width per unit basis weight of the oven-dried product in lbs/1000 $ft^2$.

In still a further embodiment of this invention, a paper and medium suitable for use in corrugated shipping containers are provided having a basis weight of at least from about 15 to about 125 lbs/1000 $ft^2$ (73–611 $g/m^2$). This paper and medium include first and second opposing surfaces, a first zone immediately adjacent to the first surface, a second surface zone immediately adjacent to the second surface, and an intermediate zone extending between the first and second surface zones. The paper and medium contain at least about 3%, and preferably up to about 16%, by weight starch on a dry basis with at least about 30%, preferably about 40% to about 50%, of the total added starch being distributed within the intermediate zone. The paper and medium are further characterized by having cross-directional ring crush strength greater than about 1.9 pounds force per 6 inches width per unit base weight of the oven-dried medium product in lbs/1000 $ft^2$.

In more detailed embodiments of this invention, the paper products can comprise up to about 16%, and more preferably about 3% to about 6%, by weight starch on a dry basis, with at least about 30% to about 50%, preferably about 40%, of the total added starch being distributed within the intermediate zone. The basis weight of paper products described herein is measured on a dry basis per 1000 square feet of the paper product and is generally greater than about 20 lbs/1000 $ft^2$ (98 $g/m^2$). The preferred basis weight range varies depending upon whether the paper will be used as medium or linerboard, since medium is generally of a thinner construction. However, the most preferred ranges include from about 20 to about 125 lbs/1000 $ft^2$ (98–611 $g/m^2$), preferably from about 30 to about 90 lbs/1000 $ft^2$ (147–440 $g/m^2$), and more preferably from about 35 to about 45 lbs/1000 $ft^2$ (171–220 $g/m^2$). For medium, a preferred range includes from about 15 to about 30 lbs/1000 $ft^2$ (73–147 $g/m^2$), and for linerboard, a preferred range includes from about 35 to about 45 lbs/1000 $ft^2$ (171–220 $g/m^2$). The provided basis weight ranges provide paper suitable for use in corrugated shipping containers.

The overall thickness of the paper is preferably at least about 0.008 inches, and can range from at least about 0.01 to about 0.04 inches in other embodiments.

One preferred process for preparing the paper products of this invention will now be described. The first step in preparing the preferred linerboard and medium of this invention is to make a suitable starch solution. One preferred method for starch preparation includes filling a 30 gallon batch starch cooker with 25 gallons of water, and adding 100 pounds of a modified, oxidized starch, preferably corn starch. The starch is preferably modified with a sodium hypochlorite treatment. An example of a suitable starch is Stayco M TM produced by the A. E. Staley Mfg. Company. A second example is a pearl corn starch modified by ammonium persulfate oxidation. A variety of starch products can be used if their viscosity has been reduced suitably as would be apparent to one skilled in the art. For example, a suitable starch solution at 26% solids and 150° F. had a Brookfield viscosity of 118 cp. at 100 r.p.m. using a #2 spindle.

After mixing the preferred starch composition with the water in a starch cooker, the combination is mixed until well dispersed to about 30% solids or more. Preferably, the dispersed mixture is heated to a range of about 190° F. to 220° F. for about 25 minutes and then cooked at that temperature for about 30 minutes. A jet cooker having about a 20 foot tail pipe for producing an appropriate residence time has been used successfully in this context. Next, about 30 milliliters of defoamer is added to the product, and then the mixture is diluted with water to a solids level of from about 18% to about 35%, preferably from about 20% to about 25%, solids. The mixture can be cooled to about 130° F. to about 150° F. before use.

For applying the starch, a size press, or equivalent means known to those in the paper-making arts, can be employed. Both sides of the paper sheet can be treated with the preferred starch compounds. The size press can be operated at a speed from about 800 to about 2500 ft/min. The nip pressure is preferably set at about 200 to about 600 pli, preferably from about 300 to about 550 pli. Although nip pressures over 300 pli are better for reducing the ineffective outer starch layer, most commercial equipment operates below this range, and acceptable results can be achieved with a nip pressure of about 200 pli. The linerboard or medium moisture content going into the size press preferably is between about 2.5% to about 21%, and more preferably is within about 6% to about 15%. Following size pressing, the preferred paper product, having a size pressed finish, is dried using forced hot air dryers or equivalent means to a reel moisture content of from about 5% to about 8%.

The common perception was that, if equivalent or larger amounts of starch were actually deposited by using higher weights and higher starch solid compositions, a larger portion of the starch would remain at the surface of the medium. Such excessive amounts of surface starch lead to the problems described above of excessive brittleness. Further, excessive surface starch would tend to close up the pores of the medium to the application of corrugation adhesives, leading also to an inferior product. Thus, statements such as those contained in U.S. Pat. No. 4,191,610 (Prior) that "Viscosity and penetration of fiber sheet limitations" necessitate a maximum 15 percent starch solid composition for medium weight paper products (col. 3, lines 26–38) actually teach away from the possibility of using higher starch solid compositions with heavier weight mediums. The present invention, however, proceeds contrary to this accepted wisdom/ignorance and recognizes the means by which improved starch deposition and resulting advantages can be obtained. While the Prior reference disclosing using sulfite waste liquor as a means for adding starch, the present invention has no need for sulfite waste liquor. The present invention achieves the goal of improved strength by forcing additional starch into the interior of the medium or linerboard. A principal manner for achieving such improved penetration is utilizing increased nip pressures, preferably from about 300 to about 550 pli.

The principles of this invention may be further understood with reference to the following test data. In each of the treated samples, the linerboard and medium were treated with a high solids, heated starch solution on a pilot coater size press prior to being converted to corrugated blanks and boxes. The data supports the claim that large improvements in the ring crush strength of the liner and medium result with a size press or equivalent surface treatment using starch and that these improvements do increase the compression strength of the combined board and boxes made with this modified material.

Tables A and B present the conditions for the starch and size press operation and the physical test in analytical data. Starch was applied at over 22% solids with a temperature in the nip of the starch press of from about 120° F. to about 130° F. The size press was operated at 540 pli and at 800 feet per minute. In each experiment, samples were taken of the untreated base stock before and after each size press treatment. This technique was followed for both the liner and medium samples shown. In the case of the medium samples, each sample was also calendared after starch sizing. The calendaring conditions were selected to achieve a caliper equivalent to that of the typical untreated mill product.

The analytical technique for measuring starch content in the sheet usually measures the small background level of starch or similar chemical compounds usually below 1%, even in the untreated product. The starch content is the percent of starch in the oven-dried sheet. Usually the starch content is higher in the medium samples primarily due to a lower basis weight of the medium compared to the linerboard.

TABLE A

| Description | Data on the Improvement of Ring Crush with Starch Treatment of Liner at the Size Press | | | | | |
|---|---|---|---|---|---|---|
| | Untreated Liner | Treated Liner | Untreated Liner | Untreated Liner | Treated Liner | Untreated Liner |
| Grade of Liner | 42 WF | 42 WF | 42 WF | 42 WF | 42 WF | 42 WF |
| Starch Solids % | N/A | 22.1 | N/A | N/A | 22.6 | N/A |
| Starch Temp. (°F.) | N/A | 121 | N/A | N/A | 125 | N/A |
| Nip Press. (pli) | N/A | 540 | N/A | N/A | 540 | N/A |
| Machine Speed (ft/min) | N/A | 800 | N/A | N/A | 800 | N/A |
| Calendar Press (pli) | 600 | 300 | 600 | 600 | 300 | 600 |
| Starch Content % | 0.05 | 7.50 | 0.05 | 0.05 | 8.77 | 0.05 |
| OD Basis Weight (lb/1000 ft$^2$) | 39.85 | 41.92 | 38.32 | 39.02 | 42.77 | 39.26 |
| CD Ring Crush (lb/6 in.) | 90.1 | 134.5 | 84.5 | 86.1 | 132.6 | 87.2 |
| MD Ring Crush | 121.7 | 183.9 | 110.9 | 111.0 | 185.8 | 122.2 |
| % Increase CD Ring Crush | 0.0 | 54.1 | 0.0 | 0.0 | 53.0 | 0.0 |
| % Increase CD RC Factor | N/A | 45.8 | N/A | N/A | 50.6 | N/A |
| % Increase MD RC Factor | N/A | 47.8 | N/A | N/A | 45.9 | N/A |
| Used in Box Cond. No. | 5A, 5B | 5C3, 5D | 5A, 5B | 5A, 5B | 5C3, 5D | 5A, 5B |
| CDRC Factor $\frac{lbF}{6\ in.}\ \frac{lbM}{1000\ ft_2}$ | 2.26 | 3.21 | 2.21 | 2.21 | 3.10 | 2.22 |
| MD RC Factor | 3.05 | 4.39 | 2.89 | 2.84 | 4.34 | 3.11 |

TABLE B

| Description | Data on the Improvement of Ring Crush with Starch Treatment of Medium at the Size Press | | | | | |
|---|---|---|---|---|---|---|
| | Untreated Liner | Treated Liner | Untreated Liner | Untreated Liner | Treated Liner | Untreated Liner |
| Grade of Medium | 26 SC | 26 SC | 26 SC | 26 SC | 26 SC | 26 SC |
| Starch Solids % | N/A | 22.4 | N/A | N/A | 22.6 | N/A |
| Starch Temp (°F.) | N/A | 130 | N/A | N/A | 128 | N/A |
| Nip Press (pli) | N/A | 540 | N/A | N/A | 540 | N/A |
| Machine Speed (ft/min) | N/A | 800 | N/A | N/A | 800 | N/A |
| Calendar Press (pli) | N/A | N/A | N/A | N/A | N/A | N/A |
| Starch Content % | 0.17 | 14.64 | 0.16 | 0.16 | 14.66 | 0.16 |
| OD Basis Weight (lb/1000 ft$^2$) | 23.77 | 28.71 | 23.47 | 23.69 | 28.23 | 23.43 |
| CD Ring Crush (lb/6 in.) | 39.0 | 68.7 | 39.9 | 39.4 | 67.8 | 40.7 |
| MD Ring Crush | 48.9 | 89.8 | 54.60 | 50.2 | 86.5 | 55.6 |
| % Increase CD Ring Crush | 0.0 | 74.1 | 0.0 | 0.0 | 69.3 | 0.0 |
| % Increase CD RC Factor | N/A | 47.5 | N/A | N/A | 49.9 | N/A |
| % Increase MD RC Factor | N/A | 42.7 | N/A | N/A | 36.49 | N/A |
| Used in Box Cond. No. | 5A, 5D | 5B, 5C3 | 5A, 5D | 5A, 5D | 5B, 5C3 | 5A, 5D |
| CDRC Factor $\frac{lbF}{6\ in.}\ \frac{lbM}{1000\ ft_2}$ | 1.64 | 2.39 | 1.70 | 1.66 | 2.40 | 1.74 |
| MD RC Factor | 2.06 | 3.13 | 2.33 | 2.12 | 3.06 | 2.37 |

Representative samples of similar linerboard produced by the process described were analyzed for starch distribution within the sheet. One method used a taper grinding process to remove portions of the paper surface in a wedge of varying depth. Iodine staining was used to determine the depth to which the starch had penetrated. Table C shows that the strength improvements from the addition of starch increased when the penetration depth increased.

The starch distributions were quantified by a technique in which successively deeper layers of the surface were ground away and the starch contents of the remaining thicknesses were measured. The starch contents of each layer were determined by difference. This yielded starch distributions through the sheet thickness exemplified by Tables D and E. On the thicker 69 lb linerboard, the center of the sheet contained essentially no starch, whereas, on the 42 lb linerboard, a significant amount of starch had penetrated to the center. Using this method, the fraction of the total starch that had penetrated beyond the 2.5 mil surface zones was determined for a number of samples that are illustrative of this invention as shown in Table F.

TABLE C

DEPTHS OF STARCH PENETRATION FOR AND CRUSH IMPROVEMENT FOR VARIOUS METHODS OF APPLICATION

| APPLICATION METHOD | Basis Weight | % Starch Solids | Penetration Top Side | Depth, mils. Wire Side | % Starch Content | % Crush Improvement | % Crush Improvement per % Starch |
|---|---|---|---|---|---|---|---|
| Gravure Roll Coater | 42 | 20 | 2.9 | 4.4 | 3.32 | 2.2 | 3.7 |
| | 69 | 18 | 3.0 | 4.4 | 2.01 | 8.1 | 4.0 |
| | 69 | 20 | 5.3 | 5.5 | 2.51 | 14.7 | 5.9 |
| Inverter Blade Coater Wire Side Only | 42 | 24 | N/A | 3.8 | 1.83 | 8.0 | 4.4 |
| Puddle Blade Coater Wire Side Only | 42 | 24 | N/A | 2.4 | 1.36 | 3.2 | 2.4 |
| Air Knife Coater | | | | | | | |
| Top Side Only | 42 | 12 | 2.2 | N/A | 1.09 | 2.1 | 1.9 |
| Wire Side Only | 42 | 12 | N/A | 3.6 | 1.04 | 1.7 | 1.6 |
| Size Press | 90 | 12 | 4.1 | 7.2 | 1.97 | 23.9 | 12.1 |
| Size Press | | | | | | | |
| Top Side Only | | | | | | | |
| 93 pli | 42 | 20 | 5.2 | N/A | 3.23 | 12.5 | 3.9 |
| 317 pli | 42 | 20 | 6.1 | N/A | 3.09 | 21.8 | 7.1 |
| Wire Side Only | | | | | | | |
| 93 pli | 42 | 20 | N/A | 5.4 | 4.48 | 41.4 | 9.2 |
| 317 pli | 42 | 20 | N/A | 7.2 | 3.87 | 38.4 | 9.9 |
| Size Press | 42 | 10 | 4.9 | 7.1 | 2.76 | 24.2 | 8.8 |
| Both Sides | 42 | 14 | 5.0 | 7.3 | 4.40 | 41.5 | 9.4 |
| | 42 | 19 | 5.2 | 4.7 | 7.54 | 62.3 | 8.3 |

TABLE D

Starch Distribution in 69 lb. Linear Treated with 26% Starch

| Zone Boundaries as Distance From Top Surface in Mils | % Starch |
|---|---|
| 0–2.3 | 12.7 |
| 2.3–4.6 | 6.6 |
| 4.6–6.9 | 2.0 |
| 6.9–9.2 | .2 |

TABLE D-continued

Starch Distribution in 69 lb. Linear Treated with 26% Starch

| Zone Boundaries as Distance From Top Surface in Mils | % Starch |
|---|---|
| 9.2–11.5 | .4 |
| 11.5–13.8 | .8 |
| 13.8–15.7 | 3.6 |
| 15.7–18.0 | 5.4 |
| 18.0–20.3 | 11.5 |

TABLE E

Starch Distribution in 42 lb. Linear Treated with 26% Starch

| Zone Boundaries as Distance From Top Surface in Mils | % Starch |
|---|---|
| 0–2.6 | 3.61 |
| 2.6–5.2 | 1.93 |
| 5.2–7.8 | 1.02 |
| 7.8–10.4 | 2.87 |
| 10.4–13.0 | 4.43 |

TABLE F

Distribution of Starch Between the Surface Zones and the Intermediate Zones on Starch Treated Liner

| Basis Wt. | Starch Solids | Nip Pressure (Pli) | Size Press Type | Speed Ft/Min | % Starch in Intermediate Zone | Starch Contents | Crush Wt. Ratio |
|---|---|---|---|---|---|---|---|
| 42 | 18 | 205 | Plain | 800 | 48.4 | 7.82 | 3.13 |
| | 18 | 540 | Plain | 800 | 50.8 | 6.93 | 2.94 |
| 69 | 20.4 | 350 | Speed Sized | 1800 | 55.7 | 4.78 | 3.02 |
| | 26 | 200 | Speed Sized | 1200 | 39.7 | 4.58 | 3.58 |
| | 26 | 200 | Speed Sized | 1200 | 35.9 | 4.64 | 3.63 |
| | 26 | 200 | Speed Sized | 1200 | 39.6 | 4.83 | 3.60 |
| | 26 | 200 | Speed Sized | 1200 | 45.3 | 5.65 | 3.35 |

The cross-direction ring crush is the relevant measurement relating to the top-to-bottom compression strength of a container, since a box manufactured from these paper samples would be loaded in the crossmachine-direction of the liner and medium. The machine-direction ring crush strength controls the end-to-end compression strength of the container.

The cross-direction ring crush of the liners, as indicated in Table A, increased 53–54% and those of the mediums increased about 69% to about 74%, as indicated in Table B. The percentage improvements are related to the starch contents. The "cross-direction ring crush factor" is the cross-ring crush divided by the basis weight with a change to metric units. It is used to compare the crush strength of various liner base weights and treatments, since ring crush can increase merely by an increase in the basis weight of fiber to a sheet. An improvement of 46% to 51% is measured in the cross-direction ring crush factor for both the liner and medium sample with starch treatment. The machine-direction crush factors increased from 36% to 48%.

The liner and medium samples were converted to a corrugated blank first and then to boxes. The last row of Tables A and B relate these samples to the number of conditions for the box samples produced.

Table G lists the four types of boxes that were made by sequencing these materials on the corrugator. The base line container had untreated liner and medium. The three other cases had either treated liner, treated medium, or both. The values of ring crush shown are the averages of the relevant cases from Tables A and B.

Improvements in board edgewise compression strength and box compression strength over the untreated base line were measured. The lowest improvement was for the board and boxes with the treated medium alone. Next in improvement, was the case involving the treated liner alone, and finally the largest improvement was found in the case with both treated liner and medium. Box compression strength was improved as much as about 56% over an untreated box with starch treatment of both components. Thus, the improvements in board and box compression are mathematically related to the improvements in the liner and medium.

The data presented indicate that starch treatment of linerboard and medium, using a surface application of starch at a size press to penetrate the surface and strengthen the interior zones of these paper products, can produce significant improvements in the ultimate box compression strength. Accordingly, this invention enables manufacturers to reduce the amount of fiber in a starch-treated linerboard or medium and still achieve an equivalent strength of the untreated product.

TABLE G

Data on the Improvement of Combined Board Edgewise Compression and Box Compression Strength

| Description of Condition | Untreated Liner/ Untreated Medium | Treated Liner/ Untreated Medium | Untreated Liner/ Treated Medium | Treated Liner/ Treated Medium |
|---|---|---|---|---|
| Box Cond. No 5A | 5A | 5D | 5B | 5C3 |
| Avg. Liner Ring Crush lb/6 in. | 87 | 133.55 | 87 | 133.55 |
| Avg. Medium Ring crush lb/6 in. | 39.8 | 39.8 | 68.3 | 68.3 |
| Board ECT lb/in. | 43 | 65 | 53 | 82 |
| Box Compression lb. | 720 | 1060 | 1010 | 1120 |
| % Increase Box Compression | 0.0 | 47.2 | 40.3 | 55.6 |

From the foregoing, it can be realized that this invention provides improvements in the compression strength of linerboard and medium by applying starch solutions at high percent solids and elevated temperatures in a size press. These compression strength improvements can lead to significant increases in the edgewise compression strength of combined board and corrugated material and result in improved box strength. The invention enables manufacturers to achieve significant reductions in fiber usage and still meet current performance specifications. While starch has previously been used in the manufacture of medium and linerboard, this is a novel application by which starch is used in such amounts as to provide unexpected advantages. Various modifications, which would be obvious to those skilled in the art, are within the scope of this invention. For example, it is anticipated that chemical equivalents of starch may be substituted in practice of the invention.

The invention proceeds contrary to the state of the art. For example, the Prior patent states that the maximum amount of starch that can be economically and practically be applied is 10 g/m$^2$ for low viscosity starches and 5 g/m$^2$ for high viscosity starches (col. 3, lines 30–38). By contrast, in the examples shown above, the starch content added was about 16.8 g/m$^2$ on linerboard and 20.4 g/m$^2$ on medium. This addition of extra starch spread throughout the paper product leads to improved ring crush strengths. It is believed that only by distributing the starch throughout the paper product can the claimed ring crush strengths be achieved while avoiding the problems inherent in excessive starch build-up on the surface of the paper product. The strengths achieved by this inventive technique exceed those that could be achieved using the parameters disclosed in Prior, at least without the use of waste sulfite liquor, which is not required for the present invention.

While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A paper suitable for use in corrugated shipping containers having a basis weight of at least about 20 lbs/1,000 ft$^2$ of the oven-dried product and an overall thickness of at least about 0.008 inches, said paper having first and second opposing surfaces, a first surface zone defined immediately adjacent to the first surface, a second surface zone defined immediately adjacent to the second surface, and an intermediate zone within the interior of the paper and extending between said first and second surface zones, each of said first and second surface zones having a thickness of 0.0025 inches;

said paper containing starch with at least about 30% of said starch being distributed within said intermediate zone;

said paper being substantially free of sulfite liquor; and said paper further being characterized by having a ring crush strength of at least about 2.4 pounds force per 6 inches width per unit basis weight of the oven-dried product in lbs/1,000 ft$^2$.

2. The paper of claim 1 containing up to about 16% starch by weight on a dry basis.

3. The paper of claim 1 containing at least about 3% to about 6% starch by weight on a dry basis with at least about 30% to about 50% of the starch being distributed within the intermediate zone.

4. The paper of claim 2 wherein said starch comprises a modified, oxidized starch.

5. The paper of claim 1 having a cross-direction ring crush strength of greater than about 2.5 pounds force per 6 inches width per unit base weight of the oven-dried product in lbs./1,000 ft$^2$.

6. The paper of claim 3 having a basis weight of from about 30 to about 90 lbs./1,000 ft$^2$ of oven-dried product.

7. The paper of claim 3 having a basis weight of from about 35 to about 45 lbs./1,000 ft$^2$ of oven-dried product.

8. The paper of claim 7 having a cross-direction ring crush strength of greater than about 2.7 pounds force per 6 inches width per unit base weight of the oven-dried product in lbs./1,000 ft$^2$.

9. The paper of claim 3 having an overall thickness of from about 0.01 to about 0.04 inches.

10. The paper of claim 1 wherein said intermediate zone contains about 40% of the total added starch.

11. The paper of claim 1 further comprising a corrugated surface.

12. The paper of claim 1, said paper further being characterized by having a cross-direction ring crush strength greater than about 1.9 pounds force per 6 inches width per unit base weight of the oven-dried product in lbs./1,000 ft$^2$ and a machine-direction ring crush strength greater than about 2.55 expressed in the same units.

13. A linerboard having a basis weight of at least about 30 lbs./1,000 ft$^2$ of oven-dried product and an overall thickness of at least about 0.008 inches, said linerboard having first and second opposed surfaces, a first surface zone immediately adjacent to the first surface, a second surface zone immediately adjacent to the second surface and an intermediate zone extending between the first and second surface zones, with each of said first and second surface zones having a thickness of 0.0025 inches;

said linerboard containing starch with at least about 30% of said starch being distributed within the intermediate zone;

said linerboard being substantially free of sulfite liquor; and said linerboard further being characterized by having a ring crush strength of at least about 2.7 pounds force per 6 inches width per unit basis weight of the oven-dried product in lbs/1,000 ft$^2$.

14. The linerboard of claim 13 wherein said starch comprises modified, oxidized corn starch.

15. The linerboard of claim 13 having a basis weight of from about 35 to about 45 lbs/1,000 ft$^2$ of oven-dried product.

16. The linerboard of claim 13 containing at least about 3% starch by weight on a dry basis.

17. The linerboard of claim 13 further characterized by having a cross-direction ring crush strength of at least about 3.01 pounds force per 6 inches width per unit basis weight of the oven-dried product in lbs/1,000 ft$^2$.

18. A medium having a basis weight of at least about 15 lbs./1,000 ft$^2$ of oven-dried product and an overall thickness of at least about 0.008 inches, said medium having first and second opposed surfaces, a first surface zone immediately adjacent to the first surface, a second surface zone immediately adjacent to the second surface and an intermediate zone extending between the first and second surface zones, with each of said first and second surface zones having a thickness of 0.0025 inches;

said medium containing starch with at least about 30% of said starch being distributed within the intermediate zone;

said medium being substantially free of sulfite liquor; and said medium further being characterized by having a ring crush strength of at least about 2.4 pounds force per 6 inches width per unit basis weight of the oven-dried product in lbs/1,000 ft$^2$.

19. The medium of claim 18 having a basis weight of from about 20 lbs/1,000 ft$^2$ to about 30 lbs/1,000 ft$^2$ of oven-dried product.

20. A method of manufacturing an improved paper product, comprising the step of:

adding starch to a paper product having a basis weight of at least about 20 lbs/1,000 ft$^2$ of the oven-dried product and an overall thickness of at least about 0.008 inches, said paper having first and second opposing surfaces, a first surface zone defined immediately adjacent to the first surface, a second surface zone defined immediately adjacent to the second surface, and an intermediate zone within the interior of the paper product extending between said first and second surface zones, each of said first and second surface zones having a thickness of 0.0025 inches by pressing said paper product with a starch composition of about 20–35% solids that is substantially free of waste sulfite liquor at a temperature of about 120° F. or above and using a size press having a nip pressure of about 200 pli or above such that at least about 30% of said starch is distributed within said intermediate zone and said improved paper product has a ring crush strength of at least about 2.4 pounds force per 6 inches width per unit basis weight of the oven-dried product in lbs/1,000 ft$^2$.

21. The method of claim 20 wherein the starch is added in an amount such that said starch comprises at least about 3% by weight on a dry basis of said improved paper product.

22. The method of claim 20 wherein the starch is added using a size press having a nip pressure of from about 300 pli to about 550 pli.

23. The method of claim 20 wherein the paper product has a moisture content of from about 2.5% to about 21% when said paper product is introduced to the size press.

24. The method of claim 20 wherein the paper product has a mixture content of from about 6% to about 15% when said paper product is introduced to the size press.

* * * * *